US011891765B2

(12) United States Patent
Powell et al.

(10) Patent No.: US 11,891,765 B2
(45) Date of Patent: Feb. 6, 2024

(54) BARRIER TRANSITION FRAMEWORK

(71) Applicant: Vandorf BT1 Inc., Stouffville (CA)

(72) Inventors: Benjamin Fraser Powell, King City (CA); William Price Longstreet, Newport Beach, CA (US); Dean Clinton Alberson, Ingram, TX (US)

(73) Assignee: Vandorf BT1 Inc., Stouffville (CA)

( * ) Notice: Subject to any disclaimer, the term of this patent is extended or adjusted under 35 U.S.C. 154(b) by 0 days.

(21) Appl. No.: 18/087,480

(22) Filed: Dec. 22, 2022

(65) Prior Publication Data

US 2023/0374745 A1 Nov. 23, 2023

Related U.S. Application Data

(60) Provisional application No. 63/343,828, filed on May 19, 2022.

(51) Int. Cl.
*E01F 15/04* (2006.01)
*E01F 15/08* (2006.01)

(52) U.S. Cl.
CPC ..... *E01F 15/088* (2013.01); *E01F 15/083* (2013.01)

(58) Field of Classification Search
CPC ..... E01F 15/143
See application file for complete search history.

(56) References Cited

U.S. PATENT DOCUMENTS 1,849,167 A 3/1932 Bente
2,047,436 A 7/1936 Shepherd
2,776,116 A 1/1957 Brickman
(Continued)

FOREIGN PATENT DOCUMENTS

KR 20090105123 A * 10/2009
WO 2007/144656 A1 12/2007
(Continued)

OTHER PUBLICATIONS

Bligh, R.P., et al., Development of Guardrail to Bridge Rail Transition, Research Report 461-1F, Texas Transportation Institute, Texas A&M University, College Station, TX, Jun. 1988.
(Continued)

*Primary Examiner* — Thomas B Will
*Assistant Examiner* — Katherine J Chu
(74) *Attorney, Agent, or Firm* — John G. Fischer, Esq.; Scheef & Stone, L.L.P.

(57) ABSTRACT

A barrier transition framework such as for use as a bridge transition, is disclosed for connection to a concrete anchor at an entrance, comprising a tubular upper transition chord having first and second beveled ends, and a tubular lower transition chord having first and second beveled ends. The first beveled ends of each of the upper and lower chords are welded to an approach deflector. The second beveled ends of each of the upper and lower chords are welded to an anchorage plate. A transition assembly is formed by connecting thrie-beams to the road-side of the transition framework. A thrie-beam may also be connected to the field-side of the transition framework. The disclosed transition framework provides a preassembled solid four bar structure with exceptional resistance to deflection in both the vertical and horizontal planes, that spans a greater distance than convention transitions.

19 Claims, 10 Drawing Sheets

(56) References Cited

U.S. PATENT DOCUMENTS 3,436,057 A * 4/1969 Mazelsky ..... E01F 15/143 188/268
3,944,187 A * 3/1976 Walker ..... E01F 15/146 188/377
4,330,106 A 5/1982 Chisolm
5,391,016 A * 2/1995 Ivey ..... E01F 15/143 404/11
5,531,540 A * 7/1996 Wasserstrom ..... E01F 15/086 404/9
6,082,926 A * 7/2000 Zimmer ..... F16F 7/122 404/9
6,179,516 B1 * 1/2001 Ivey ..... E01F 15/146 404/9
6,719,483 B1 * 4/2004 Welandsson ..... E01F 15/0476 404/9
6,830,407 B1 12/2004 Ochoa
7,036,798 B1 * 5/2006 Olson ..... E01F 7/025 239/289
7,168,880 B2 * 1/2007 Kennedy, Jr. ..... E01F 15/146 404/9
7,185,882 B2 * 3/2007 Buth ..... E01F 15/143 248/66
7,396,184 B2 * 7/2008 La Turner ..... E01F 15/146 404/9
7,556,243 B2 7/2009 Williams
7,758,277 B2 7/2010 La Turner et al.
8,074,761 B2 * 12/2011 LaTurner ..... F16F 7/123 180/274
8,424,849 B2 * 4/2013 James ..... E01F 15/025 256/13.1
8,500,103 B2 8/2013 Alberson et al.
8,534,952 B2 9/2013 Vladislavic
8,894,318 B2 * 11/2014 Sayre ..... C08G 18/3215 528/65
8,974,142 B2 * 3/2015 Buehler ..... E01F 15/08 404/6
9,051,698 B1 * 6/2015 Anghileri ..... E01F 15/146
9,714,493 B1 * 7/2017 Dyke ..... E01F 15/143
10,006,179 B2 * 6/2018 Buehler ..... E01F 15/08
10,501,901 B2 12/2019 Anghileri et al.
10,648,142 B2 5/2020 Gremling
10,851,503 B2 12/2020 Alberson et al.
11,453,988 B2 * 9/2022 Lim ..... E01F 15/0438
2006/0072967 A1 4/2006 Sasse
2017/0081815 A1 * 3/2017 Koestner ..... E01F 15/0461
2022/0220681 A1 * 7/2022 Maus ..... E01F 15/143

FOREIGN PATENT DOCUMENTS

WO 2014/028956 A1 2/2014
WO 2017/007760 A1 1/2017

OTHER PUBLICATIONS

Bligh, R.P. et al., Development of a Strong Beam Guardrail-to-Bridge-Rail Transition, Transportation Research Record 1198, pp. 105-116, Texas Transportation Institute, Texas A&M University System, College Station, TX, 1988.
Williams, W.F., et al., TTI: 9-1002-12, MASH TL-3 Testing and Evaluation of the TXDOT T131RC Bridge Rail Transition, Texas A&M Transportation Institute, College Station, TX, Mar. 2013.
Williams, W.F., et al., TTI: 0-6954, Mash TL-3 Evaluation of Guardrail to Rigid Barrier Transition Attached to Bridge or Culvert Structure, Texas A&M Transportation Institute, College Station, TX, Oct. 2020.

* cited by examiner

BARRIER TRANSITION FRAMEWORK

RELATED APPLICATION

This application claims priority to Provisional Application 63/343,828, filed May 19, 2022.

FIELD OF THE DISCLOSURE

This disclosure relates to a preassembled traffic barrier system designed for the special application of road to anchor transitions, such as a bridge transitions, where the transitions resist deflection in multiple planes.

BACKGROUND

Road-side guardrails installed along highways protect motorists from the road-side hazards including non-recoverable slopes and rigid objects. The most common type of road-side protection is the American Association of State Highway and Transportation Officials (AASHTO) M 180 W-Beam Guardrail Panel (guardrail). Guardrail and other types of road-side safety devices are deemed 'crashworthy' or proven acceptable for use under specified conditions either through physical crash testing via AASHTO Manual of Assessing Safety Hardware (MASH) or in-service performance.

Where road-side guardrail is to be connected to a rigid object, such as a bridge barrier or bridge pier, the approach road-side guardrail is gradually stiffened so vehicular pocketing, snagging, or penetration at the point of connection between transition and a rigid object can be avoided. Pocketing is an undesirable behavior of guardrail involving relatively large lateral displacements within a relatively short longitudinal distance that can result in large longitudinal decelerations as the front of a vehicle contacts a portion of a barrier deformed at a sharp angle relative to the vehicle's path.

Penetration is the overall failure and separation of a guardrail, allowing an impacting vehicle to access an area of concern/hazard the guardrail intends to shield. Snagging is contact between a portion of a vehicle, such as a wheel or frame element, and the guardrail component that is approximately perpendicular to the normal direction of vehicle travel. The most common type of snagging is when a wheel engages the side of a guardrail post. The degree of snagging depends on the degree of engagement.

Transitions for locations where drainage features (e.g., curbs, drainage drop-basins, curb inlets, drainage swales, and public utilities (telecommunications, natural gas)) are constructed directly adjacent to the rigid object are susceptible to initiating vehicular instability that can, in some instances, adversely affect the crashworthiness of the transition. However, some transition designs incorporate a curb to reduce the probability of a vehicle snagging on the end of a ridged bridge railing. The most common method in practice today uses nesting or stacked w-beam or thrie-beam guardrail panels to stiffen the transition to a ridged object that has a relative short distance between the last transition post and the ridged object and, in many cases, is equivalent to a single guardrail transition post spacing (i.e., 2 ft. thru 3 ft 6 in.). This distance is problematic for utilities requiring a larger gap distance between the last transition post and the ridged object being shielded.

In addition to its application for use as a bridge transition, the disclosed barrier transition framework can be used in other locations where transitioning from a flexible barrier system to a solid barrier system. These would include, for example, transitioning from a W-Beam roadside barrier system to a rigid concrete or steel structure. The benefits of this application include providing a structure of intermediate flexibility capable of transitioning over drainage and utility features as described above.

Attempts to lengthen the transition span have resulted in systems that lack the tolerable transitional deflection limits needed for a bridge approach. One experimental attempt to increase the resistance to deflection when the span was increased included placing wooden poles between field-side facing and road-side facing W beams. While it provided additional resistance to deflection in the horizontal direction, it did not provide or allow the benefits of the spatial end anchoring of the present invention, required a field-side thrie-beam, required on site assembly which was cumbersome, and failed to provide the level of resistance to deflection achieved by the present invention.

A significant disadvantage of conventional guardrail bridge transitions is that they often conflict with utilities and drain structures. A disadvantage of conventional guardrail bridge transitions is that there is an eight-foot gap between the anchoring and post supported guardrail. The guardrail spanning is required to accommodate underground utilities and/or drop basin inlets for off structure drainage, rendering the guardrail spanning this space unreliable. Another disadvantage of conventional guardrail bridge transitions is that they are often anchored in poor soil conditions.

Another disadvantage of conventional guardrail bridge transitions is that they require an overpour of filler on hillsides leading to bridges. These provide unreliable foundations for anchoring guardrail posts. Another disadvantage of conventional guardrail bridge transitions is that drainage at the transition degrades the overpour of filler and poor soil surrounding support posts. Another disadvantage of conventional guardrail bridge transitions as they provide a guardrail that is too rigid, or too soft. An example of a guardrail that is too soft is one in which posts are secured in soft soil.

Therefore, there is a need for a guardrail bridge transition system that overcomes these disadvantages and provides a safer entry and exit between roads and bridges. Specifically, there is a need for a guardrail bridge transition assembly that accommodates utilities and drainage structures without interference, is not subject to poor soil foundation for securing guardrail posts and is not subject to excessive erosion by drainage. There is also a need for a guardrail bridge transition system that provides a greater resistance to deflection, even though extending over a longer span before attachment to a subterranean post. Finally, there is a need for a guardrail bridge transition that minimizes on location assembly and construction requirements.

An advantage of the embodiments of the disclosed guardrail bridge transition system is that it provides an improved performance that is applicable to both existing transition installations and new transition installations. Another advantage of the embodiments of the disclosed invention is that it comprises a sled component that arrives on-site preassembled and ready for installation. Another advantage of the embodiments of the disclosed invention is that it provides significant time savings on schedule, where post driving operations are reduced by eliminating at least three larger transition posts.

Another advantage of the present invention is that it can be used to replace in-service transitions, as well as new installations. Another advantage of the present invention is that it is fully reversable for use on either side of the road. Another advantage of the present invention is that it provides a visually seamless integration with a thrie-beam guardrail installed before the transition.

A primary advantage of the embodiments of the disclosed invention is that it provides a traffic bridge barrier system that uniquely resists deflection in multiple planes, thus providing safer entry and exit transitions between roads and bridges. Another advantage of the embodiments of the disclosed invention is that it provides a bridge transition assembly that accommodates utilities and drainage structures without interference by means of a longer span than conventional transitions. Another advantage of the embodiments of the disclosed invention is that it provides a system that is less vulnerable to failure due to poor soil features proximate to the bridge.

Another advantage of the embodiments of the disclosed invention is that it provides a foundation for securing guardrail posts that is less vulnerable to excessive erosion by drainage.

In summary, the disclosed invention provides a unique solution to the engineering constraints and challenges of providing a bridge transition that provides increased safety and cost-efficient installation and repair and overcomes the disadvantages of known solutions. Further, the embodiments of the disclosed invention satisfy the crash test requirements of AASHTO MASH Test Level 3, Test 3-20, and Test 3-21.

The advantages and features of the embodiments presently disclosed will become more readily understood from the following detailed description and appended claims when read in conjunction with the accompanying drawings in which like numerals represent like elements.

SUMMARY

A transition framework and transition assembly are disclosed. In one embodiment, a prefabricated transition framework for use when transitioning from standard road barriers to an anchored road barrier, such as at the foundation of a bridge transition, is disclosed. The transition framework is a hot-dipped galvanized steel having a pair of 4½" OD schedule 80 tubular chords. The ends of the tubulars are beveled and welded in solid connection to an approach deflector at one end and an anchorage plate at the other to maintain the tubulars in stiff parallel orientation.

As disclosed herein, the transition framework uniquely resists deflection in two planes, the horizontal plane and the vertical plane, thus providing a significantly improved performance over known previous designs. By anchoring the ends of the transition chords, vertical expansion of the impacted thrie-beam panel is resisted, absorbing more energy in the thrie-beam distortion and providing greater resistance to horizontal displacement. This allows the transition framework to provide the required stiffness while also providing a greater gap distance of 108 inches (9 ft.) between the center of a connecting transition post and a ridged bridge barrier. The tested and proven uninterrupted span of 105 inches accommodates all utilities at any transition requiring additional room (i.e., drop-basin for off-structure drainage, public utilities, etc.).

In one embodiment, a transition for anchorage to a concrete barrier at a bridge entrance is disclosed, comprising a tubular upper chord having first and second ends. A tubular lower chord is provided, also having first and second ends. The first end of each of the upper and lower chords is welded to an approach deflector. The second end of each of the upper and lower chords is welded to an anchorage plate. The transition as described provides a preassembled solid four bar assembly with exceptional strength and resistance to deflection in both the vertical and horizontal planes.

In another embodiment, the approach deflector is connectable to a subterranean mounted guardrail post, and the end anchor is connectable to a bridge anchor.

In another embodiment, the upper chord and lower chord have a 4.5" outside diameter. In another embodiment, the upper chord and lower chord are schedule 80 tubulars. In another embodiment, the center of the upper chord to the center of the lower chord is separated by a distance of 15¼".

In another embodiment, the first and second ends of the tubular upper chord and the first and second ends of the tubular lower chord are beveled.

In another embodiment, the approach deflector further comprises a weldment panel welded to the first beveled end of the upper and lower chords, a connection panel disposed at an obtuse angle to the weldment panel, and a plurality of vertically separated fastener holes on the connection panel for fastener connection to an embedded post. A deflection panel is disposed at an obtuse angle to the connection panel to prevent snagging of vehicles impacting the approach deflector.

In another embodiment, the anchorage plate further comprises a weldment panel welded to the second beveled end of each of the upper and lower chords, and a connection panel disposed at an obtuse angle to the weldment panel. A plurality of vertically separated holes is provided on the connection panel for receiving fasteners for connection to a concrete block at a bridge entrance.

In another embodiment, a bridge transition assembly is disclosed having a transition framework comprising a tubular upper chord having first and second ends, a tubular lower chord having first and second ends, an approach deflector welded to the first end of the upper and lower chords, and an anchorage plate welded to the second end of the upper and lower chords. The approach deflector is affixed to a guardrail post, and the anchorage plate is affixed to a bridge anchor. A first thrie-beam guardrail having a first end and an opposite second end is positioned on the road-side of the bridge transition, and over the upper and lower chords. The thrie-beam is affixed to the approach deflector and the guardrail post at its first end, and to a thrie-beam terminal connector at its second end. The terminal connector is attached to the anchorage plate and bridge anchor at its second end.

In a related embodiment, a second thrie-beam guardrail is provided, having a first end and an opposite second end. The second thrie-beam is positioned on top of the first thrie-beam in a nested configuration. The second thrie-beam is affixed to the first thrie-beam, the approach deflector, and the guardrail post at its first end, and to the first thrie-beam at its second end.

In another related embodiment, a field-side thrie-beam guardrail is provided.

DETAILED DESCRIPTION

The following description is presented to enable any person skilled in the art to make and use the invention and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown but is to be accorded the widest scope consistent with the principles and features disclosed herein.

Figure 1:
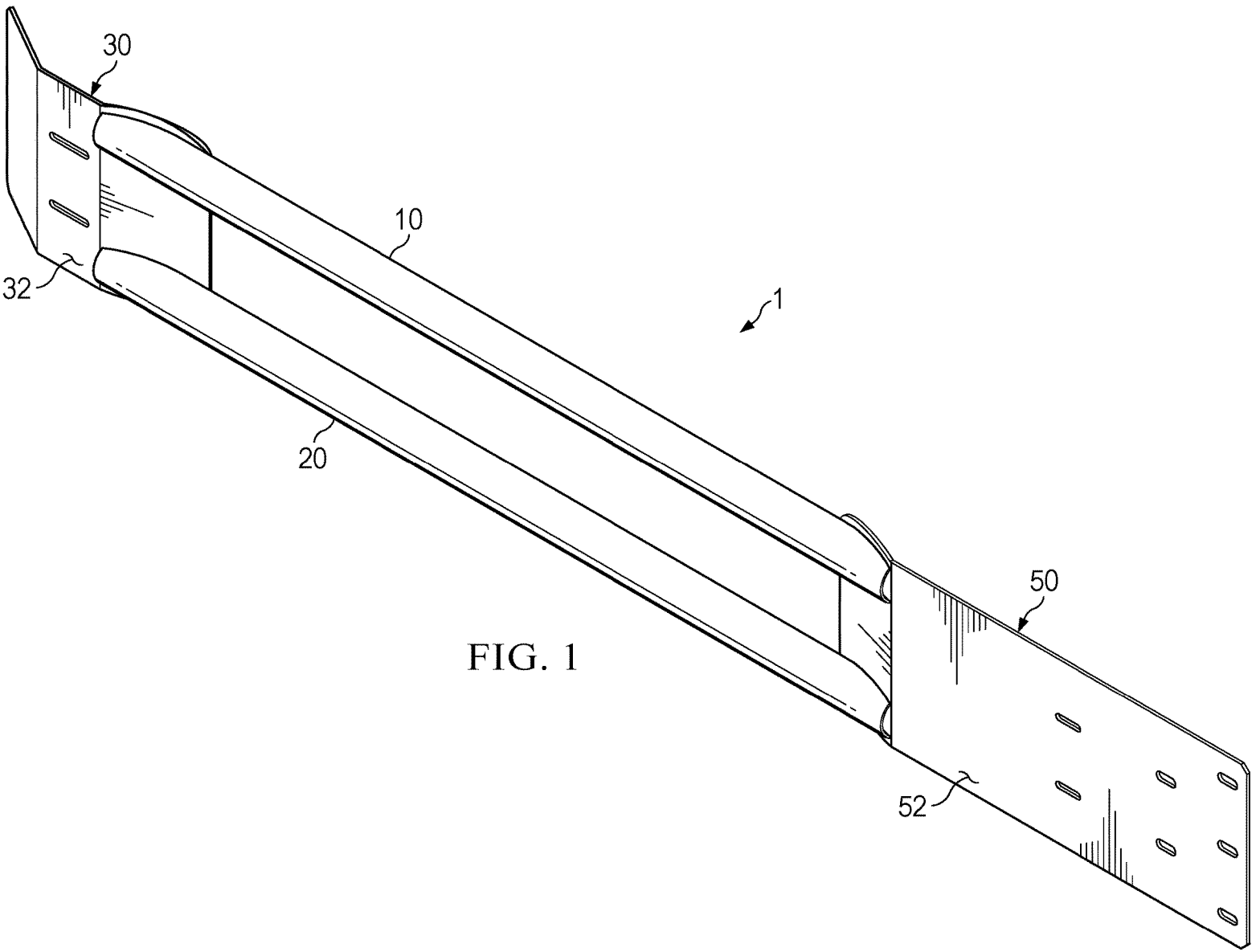
FIG. 1 is a front (road-side) perspective view of the bridge transition in accordance with one embodiment of the invention.
Figure 4:
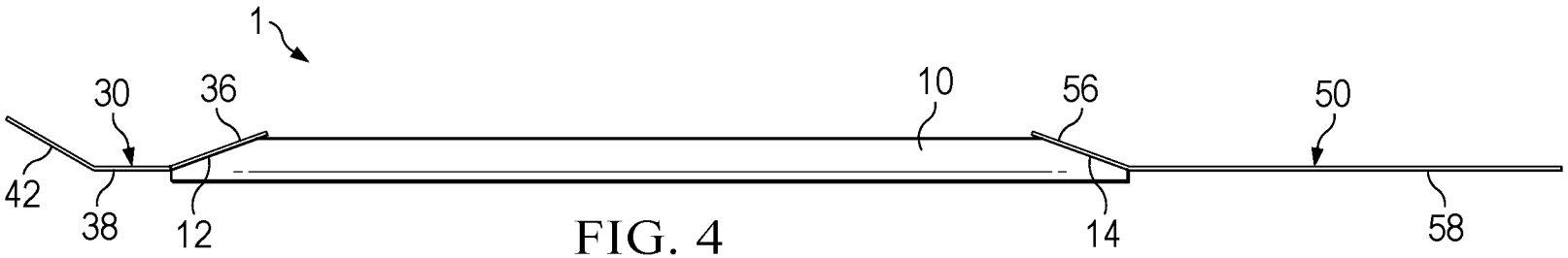
FIG. 4 is a top view of the bridge transition in accordance with the embodiment of FIGS. 1-3.

FIG. 1 is a front (road-side) perspective view of a transition framework 1, illustrated in accordance with an embodiment of the invention. As seen in FIG. 1, transition framework 1 comprises a tubular upper chord 10 and a lower chord 20. As best seen in FIG. 4, a first end 12 of upper chord 10 and a first end 22 of lower chord 20 are welded to a road-side 32 of an approach deflector 30. A second end 14 of upper chord 10 and a second end 24 of lower chord 20 are welded to road-side 52 of an anchorage plate 50.

Figure 2:
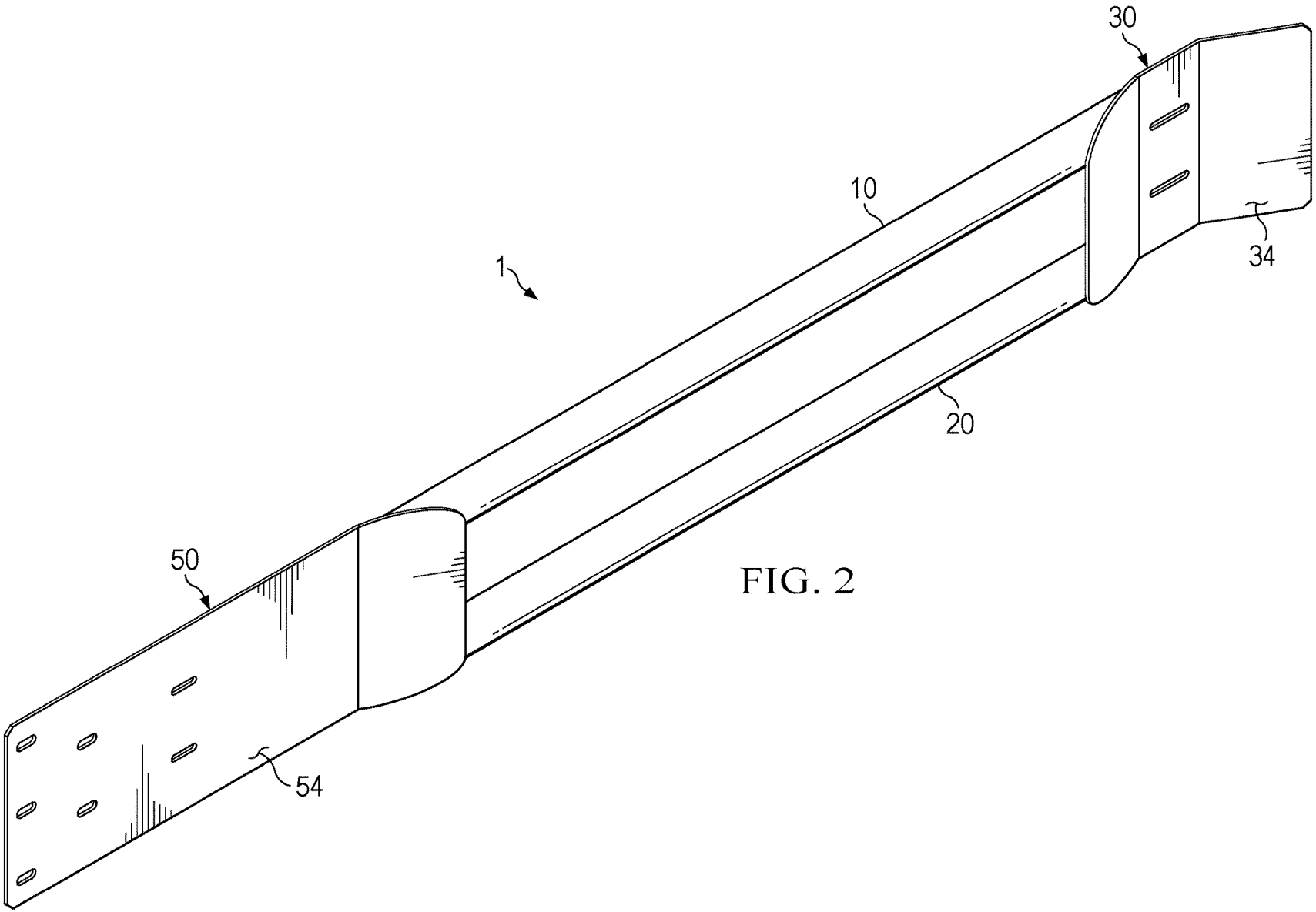
FIG. 2 is a back (field-side) perspective view of the bridge transition in accordance with the embodiment of FIG. 1.

FIG. 2 is a back (field-side) perspective view of transition framework 1 in accordance with the embodiment of FIG. 1. As seen in this view, approach deflector 30 has a field-side 34 opposite to road-side 32. Anchorage plate 50 has a field-side 54 opposite to road-side 52.

Figure 3:
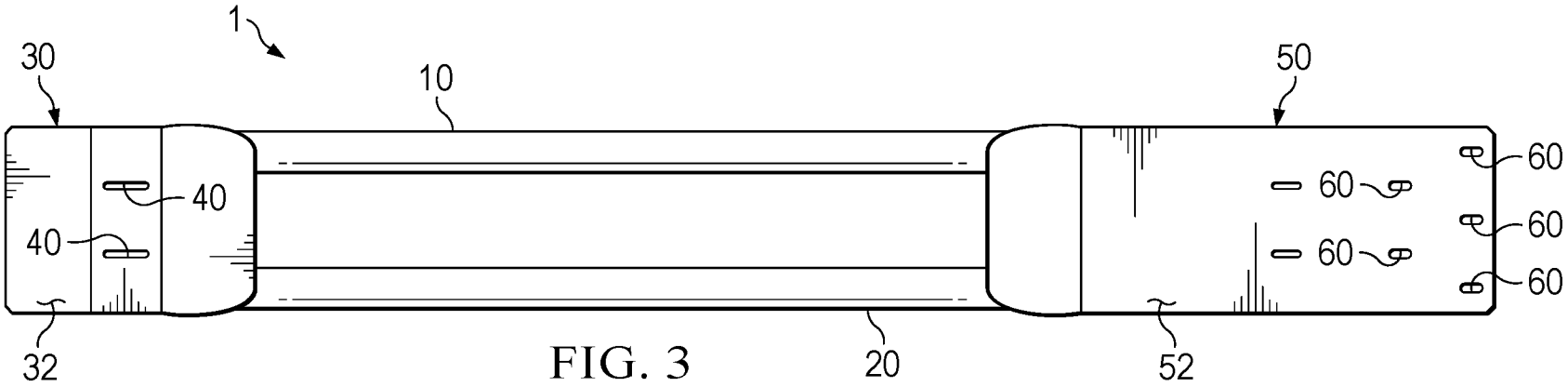
FIG. 3 is a front side view of the bridge transition in accordance with the embodiment of FIGS. 1-2.

FIG. 3 is a front side view of transition framework 1 in accordance with the embodiment of FIGS. 1-2. In FIG. 3, the road-side view of transition framework 1 is seen. Anchorage plate 50 has a plurality of fastener holes 60. Fastener holes 60 receive fasteners 62 for connection of anchorage plate 50 to a concrete bridge anchor 100. Approach deflector 30 has a plurality of fastener holes 40. Fastener holes 40 receive fasteners 62 for connection of approach deflector 30 to a guardrail post 110.

Figure 5:
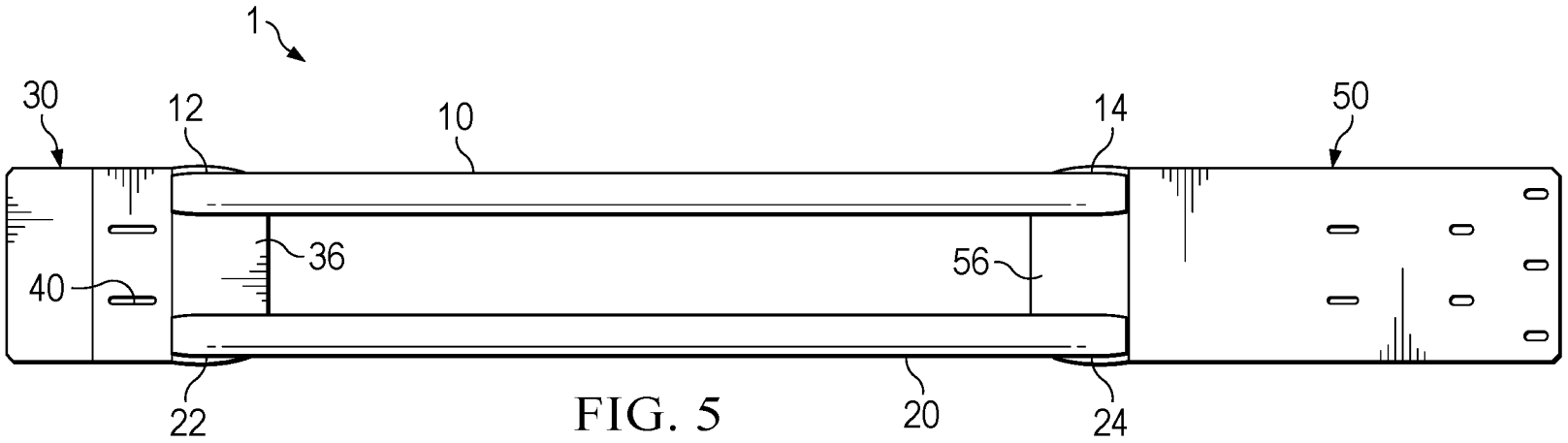
FIG. 5 is a back side view of the bridge transition in accordance with the embodiment of FIGS. 1-4.

FIG. 4 is a top view of transition framework 1 in accordance with the embodiment of FIGS. 1-3. FIG. 5 is a back side view of transition framework 1 in accordance with the embodiment of FIGS. 1-4. As seen in FIG. 5, upper chord 10 has a first beveled end 12 and a second beveled end 14. Lower chord 20 has a first beveled end 22 and a second beveled end 24. As illustrated in FIG. 4, approach deflector 30 comprises a weldment panel 36 to which are welded the first beveled ends 12 and 22 of tubular upper chord 10 and lower chord 20. Anchorage plate 50 comprises a connection panel 58 and a weldment panel 56 to which are welded the second beveled ends 14 and 24 of tubular upper chord 10 and lower chord 20.

Figure 11:
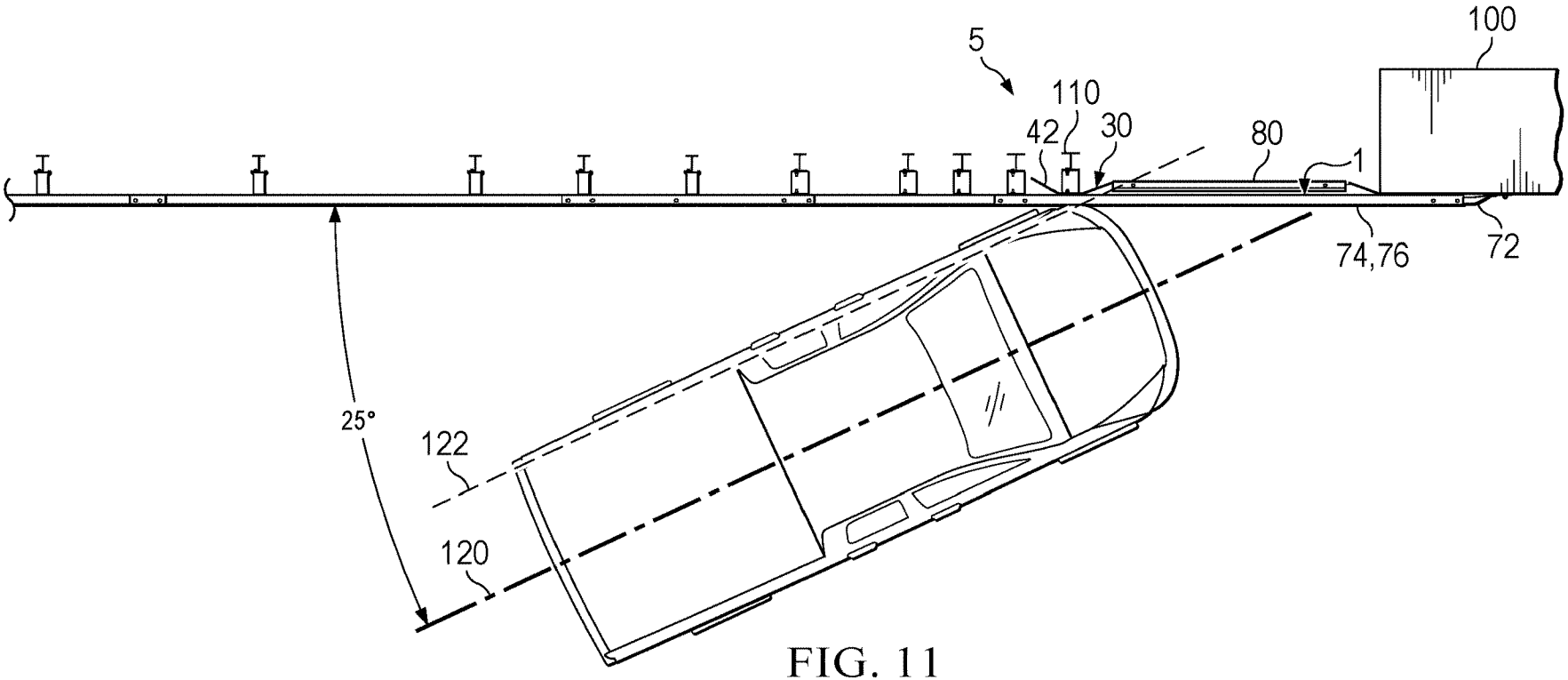
FIG. 11 is a top view of a MASH Test 3-21 vehicle crash test which was performed in which the disclosed bridge transition was used as the bridge transition and secured with front and back side thrie-beams.

A connection panel 38 is disposed at an obtuse angle to weldment panel 36. As best seen in FIG. 5, fastener holes 40 are disposed on connection panel 38. Referring back to FIG. 4, a deflector panel 42 is disposed at an obtuse angle to connection panel 38. As best seen in FIG. 11, deflector panel 42 serves to discourage an impacting vehicle from snagging on guardrail post 110.

In one embodiment, upper chord 10 and lower chord 20 have an outside diameter of approximately 4.5". In another embodiment, upper chord 10 and lower chord 20 are made from schedule 80 tubulars.

Figure 6:
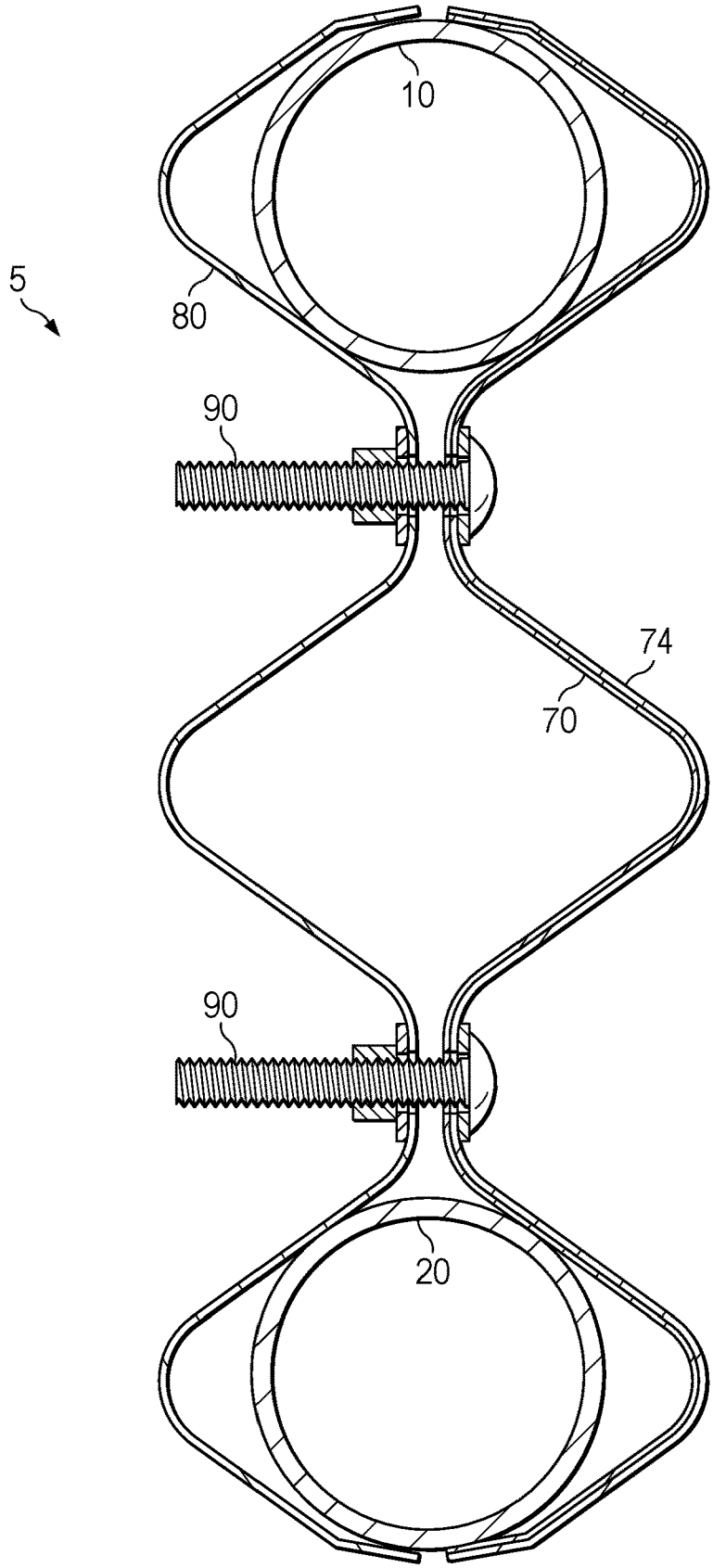
FIG. 6 is an end view of the bridge transition of the present invention, illustrated as having thrie-beams positioned on the front and the back of the embodiment of the bridge transition disclosed in FIGS. 1-5, and as connected together with threaded fasteners.

FIG. 6 is an end view of transition framework 1, illustrated as incorporated in bridge transition assembly 5. In this embodiment, a first thrie-beam 70 is positioned on the road-side of transition framework 1, and over upper chord 10 and lower chord 20 so as to nest first thrie-beam 70 over upper chord 10 and lower chord 20. In the embodiment illustrated, a field-side thrie-beam 80 is positioned on the field-side of transition framework 1, and over upper chord 10 and lower chord 20 so as to nest field-side thrie-beam 80 over upper chord 10 and lower chord 20. Fasteners 90 connect first road-side thrie-beam 70 to field-side thrie-beam 80 between upper chord 10 and lower chord 20.

Also, in the embodiment illustrated, a second road-side thrie-beam 74 is nested over first road-side thrie-beam 70 to provide additional strength and resistance to deformation. As seen in this view, thrie-beams 70 and 74 have an accordion-like profile that is presented road-side for impact by a vehicle. The center of thrie-beams 70 and 74 would normally expand thrie-beams 70 and 74 vertically in response to a direct impact.

Unique to the present invention, the solid four bar configuration of transition framework 1 resists vertical expansion of thrie-beams 70 and 74, and coincident horizontal deformation. As disclosed, the impact of the disclosed invention requires horizontal buckling at the center of thrie-beams 70 and 74 between upper chord 10 and lower chord 20, which absorbs much more energy than horizontal expansion if upper chord 10 and lower chord 20 were not solidly anchored at their ends. The benefits increase resistance to deflection and increased probability of a repairable bridge transition on lower to medium vehicle impacts.

Figure 7:
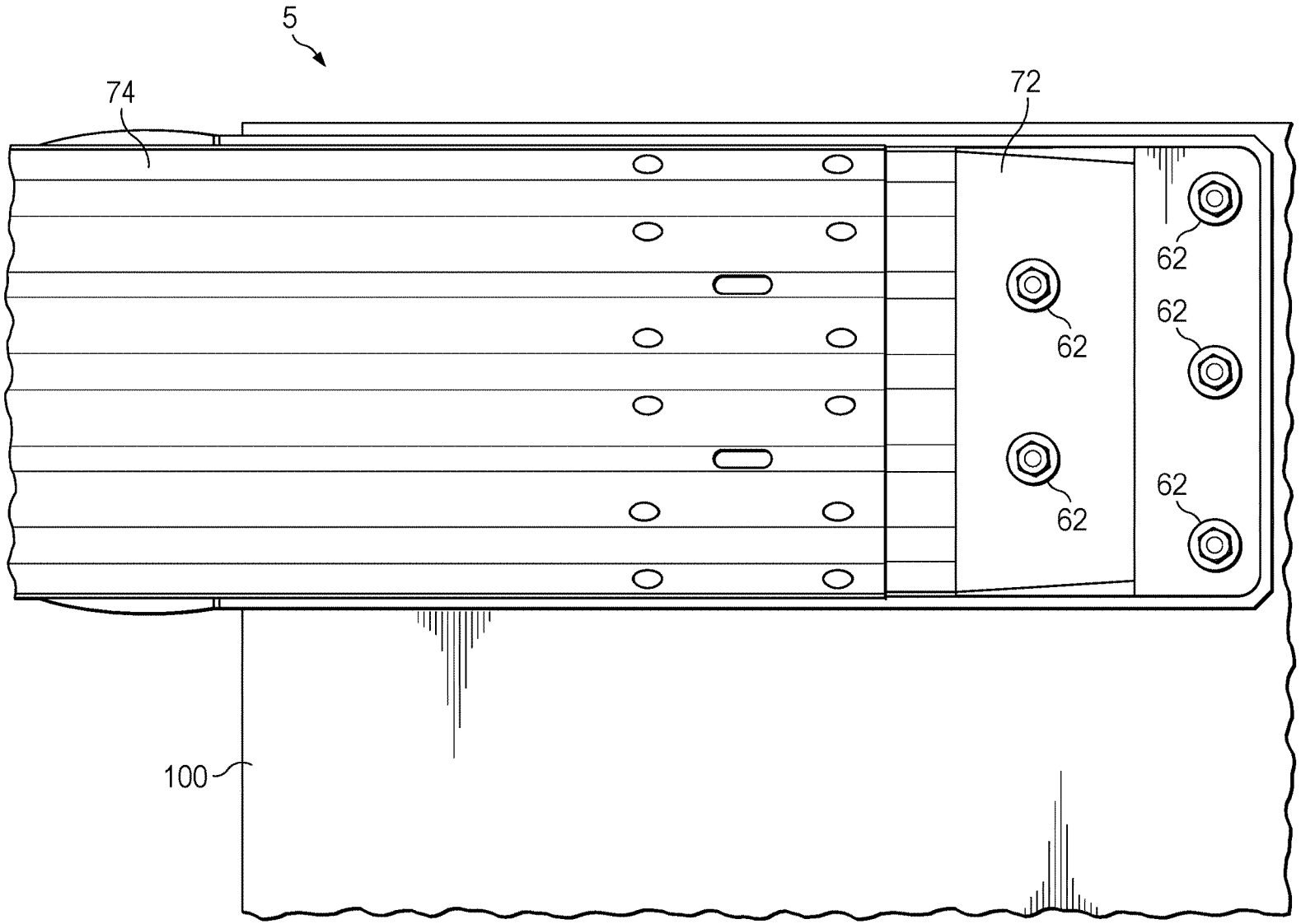
FIG. 7 is a front side sectional view of a thrie-beam terminal connector connected to the embodiment of the bridge transition disclosed in FIGS. 1-7.
Figure 8:
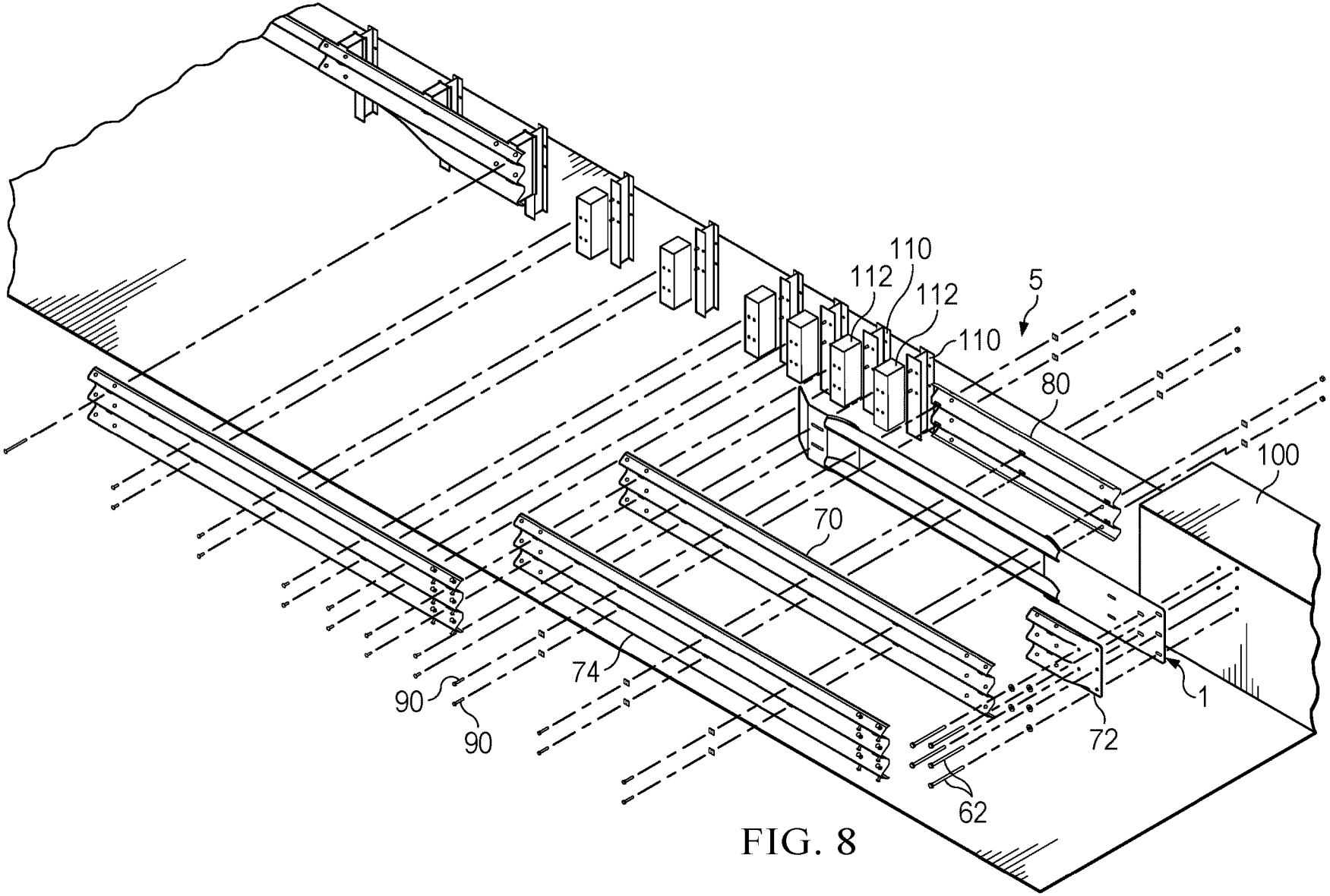
FIG. 8 is an isometric exploded view of an assembly including the disclosed embodiment of the bridge transition positioned as the transition between road-side thrie-beam guardrails and a bridge anchor.

FIG. 7 is a front side sectional view of a thrie-beam terminal connector 72 incorporated in the disclosed embodiments of bridge transition assembly 5. As illustrated in FIG. 7 and as best seen in FIG. 8, terminal connector 72 is connected to anchorage plate 50 of transition framework 1 and concrete anchor 100 at the entrance to a bridge. Fasteners 62 are located in receiving holes on terminal connector 72 and pass through fastener holes 60 on connection panel 58 of anchorage plate 50 (see FIG. 3).

FIG. 8 is an isometric exploded view of bridge transition assembly 5. As seen in FIG. 8, and as referenced in FIG. 9, transition framework 1 is positioned as the transition between guardrail post 110 and concrete anchor 100. A spacer 112 may be positioned between guardrail post 110 and transition framework 1. A spacer 112 may be positioned between a guardrail post 111 and road-side thrie-beam 70.

Fasteners 90 connect transition framework 1 and road-side thrie-beams 70 and 74 to guardrail post 111. Guardrail post 110 is the first connecting guardrail post on the approach side of concrete anchor 100. Guardrail post 111 is the second connecting guardrail post on the approach side of the concrete barrier.

As further seen in FIG. 8, fasteners 62 rigidly connect anchorage plate 50 of transition framework 1 and terminal connector 72 to concrete anchor 100 at the entrance to a bridge. First road-side thrie-beam 70 is positioned over upper chord 10 and lower chord 20. Second road-side thrie-beam 74 is nested over first road-side thrie-beam 70 to provide additional strength and resistance to deformation.

Field-side thrie-beam 80 is positioned on the field-side of transition framework 1, and over upper chord 10 and lower chord 20 so as to nest field-side thrie-beam 80 over upper chord 10 and lower chord 20. Fasteners 90 connect first road-side thrie-beam 70 to field-side thrie-beam 80 between upper chord 10 and lower chord 20 to form an envelope over upper chord 10 and lower chord 20.

First road-side thrie-beam 70 and second road-side thrie-beam 74 are connected to terminal connector 72 by threaded fasteners 62. The opposite ends of first road-side thrie-beam 70 and second road-side thrie-beam 74 are connected by threaded fasteners 90 to approach deflector 30 and guardrail post 110.

Figure 9:
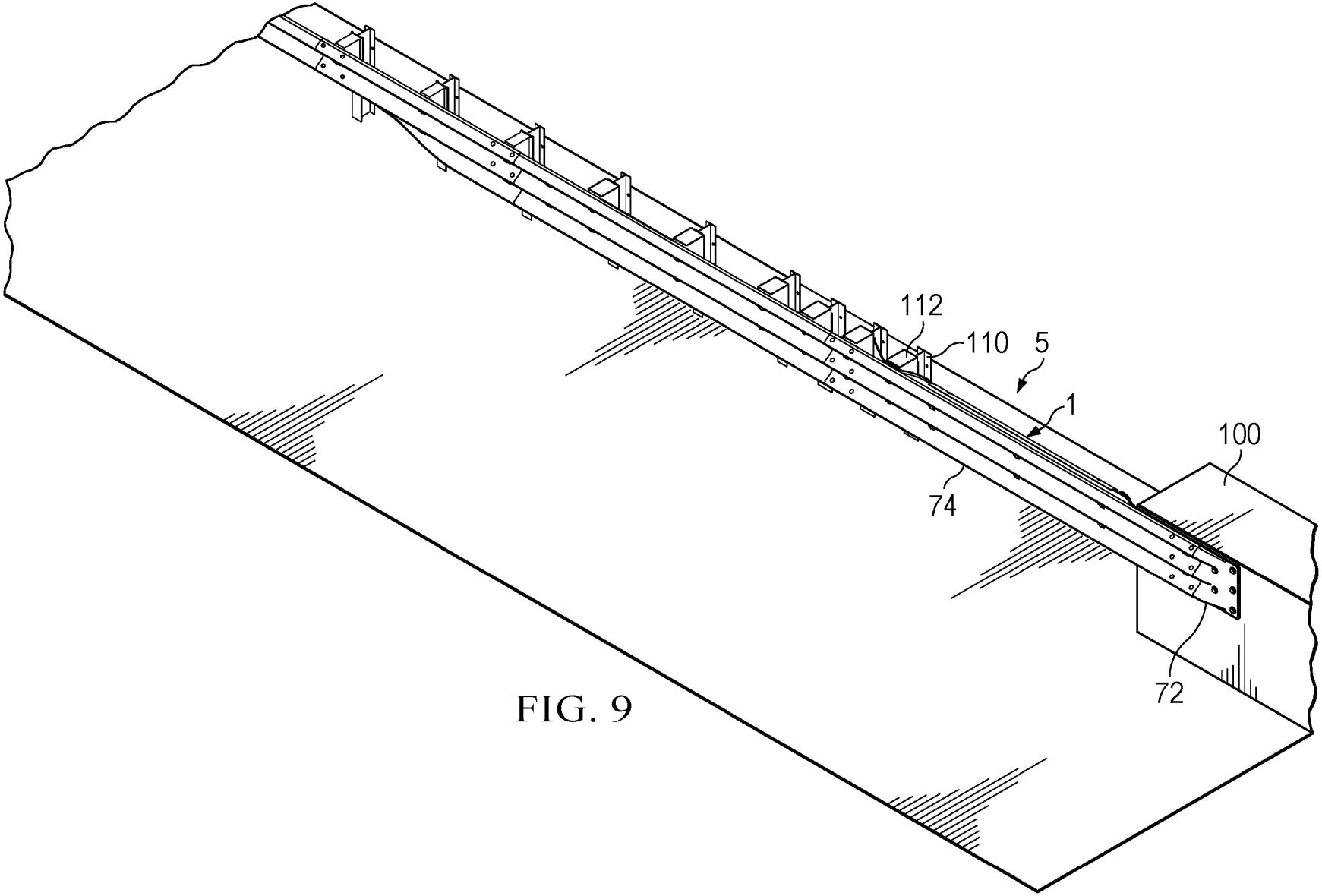
FIG. 9 is an isometric view of the assembled components of FIG. 8, including the disclosed embodiment of the bridge transition as the transition between road-side thrie-beam guardrails and a bridge anchor.

FIG. 9 is an isometric view of the assembled components of FIG. 8, illustrating bridge transition assembly 5 assembled with transition framework 1 extending between guardrail post 110 and concrete anchor 100 at a bridge entrance. In this manner, construction of bridge transition assembly 5 is complete.

It is noted that the disclosed embodiments permit the addition of one or more second road-side thrie-beams 74 as nested over first road-side thrie-beam 70. It is further noted that the disclosed embodiments permit the inclusion of one or more field-side thrie-beams 80. Unique to the present invention, transition framework 1 does not require field-side thrie-beam 80 to support rigidly anchored upper chord 10 and lower chord 20, facilitating the very advantageous premanufacture of transition framework 1 for use at the bridge location.

Transition framework 1, as preassembled, can advantageously be used to replace in-service transitions, as well as new installations. Additionally, transition framework 1 is fully reversable for use on either side of the road. Transition framework 1 provides further significant installation time savings in that it eliminates up to four guardrail posts for post pounding operations.

In the embodiments illustrated, transition framework 1 and bridge transition assembly 5 permit a successfully MASH tested distance of 108 inches (9 ft.) between the center of guardrail post 110 and the edge of ridged concrete anchor 100. The tested and proven span of 108 inches provides 105 inches of uninterrupted space that accommodates all utilities at a structure requiring additional room (i.e., drop-basin for off-structure drainage, public utilities, etc.) to obtain the benefits of the invention. The increased span increases reliability as the primary guidepost is further distanced from the soil at the bridge interface.

Figure 10:
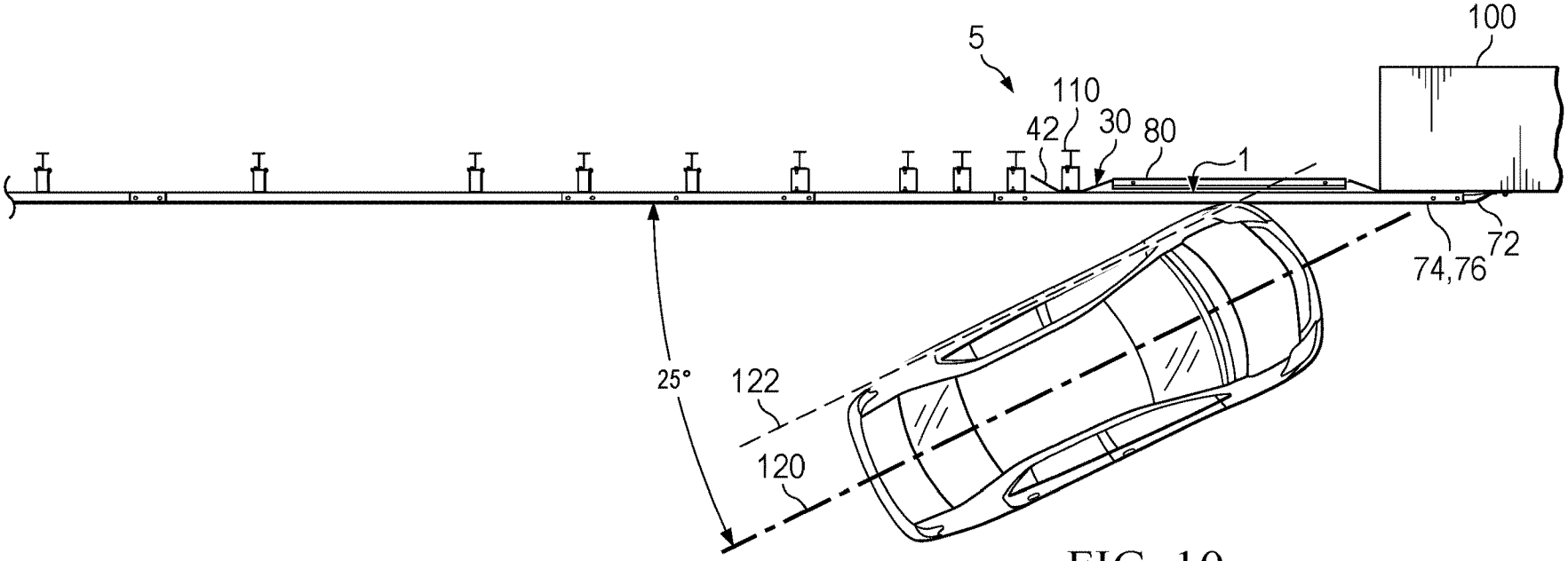
FIG. 10 is a top view of a MASH Test 3-20 vehicle crash test which was performed in which the disclosed bridge transition was used as the bridge transition and secured with front and back side thrie-beams.

FIG. 10 is a top view of a MASH Test 3-20 vehicle crash test which was performed in which the disclosed transition framework 1 was incorporated into bridge transition assembly 5 as the bridge transition tested in accordance with MASH testing protocols. In FIG. 10, the vehicle has a centerline of travel 120, and a line of critical impact point, or CIP 122. To satisfy the test requirements, vehicle centerline 120 is at an angle of 25° to bridge transition assembly 5.

In the TL3-20 testing, a 2,425-lb vehicle impacts the critical impact point (CIP) of the transition at a nominal impact speed and angle of 62 mi/h (100 km/hr) and 25 degrees, respectively. This test investigates a barrier's ability to successfully contain and redirect a small passenger vehicle.

On Apr. 19, 2022, testing was performed on the disclosed embodiment of the invention having a single field-side thrie beam 80 and a pair of nested road-side thrie beams 70 and 74. Table 1 below demonstrates the success of bridge transition assembly 5 in actual MASH testing on a small sedan weighing 2,603 lbs. performed by Applus IDIADA KARCO Engineering.

Table 1

General Information
- Test Agency: Applus IDIADA KARCO Engineering, LLC
- Test Number: P42020-01
- Test Date: Apr. 19, 1922
- Test Article: Northern Infrastructure Products, Bridge Connection Test Vehicle Test Vehicle
- Description: 1100C, MASH 3-20
- Test Inertial Mass: 1101 kg
- Gross Static Mass: 1183 kg Impact Conditions
- Speed: 101.6 km/h
- Angle: 25.0 degrees Occupant Risk Factors
- Impact Velocity (m/s) at 0.0762 seconds on left side of interior
- x-direction 7.1
- y-direction −10.7
- THIV (km/hr): 45.3 at 0.0748 seconds on left side of interior
- THIV (m/s): 12.6
- Ridedown Accelerations (g's)
- x-direction −17.1 (0.0770-0.0870 seconds)
- y-direction 6.5 (0.2046-0.2146 seconds)
- PHD (g's): 17.5 (0.0769-0.0869 seconds)
- ASI: 2.59 (0.0523-0.1023 seconds)

Max. 50 msec Moving Avg. Accelerations (g's)
- x-direction −15.0 (0.0381-0.0881 seconds)
- y-direction 20.3 (0.0263-0.0763 seconds)
- z-direction −3.5 (0.0033-0.0533 seconds)

Max Roll, Pitch, and Yaw Angles (degrees)
- Roll −12.6 (0.3501 seconds)
- Pitch −5.1 (0.2347 seconds)
- Yaw 52.9 (0.5998 seconds)

FIG. 11 is a top view of a MASH Test 3-21 with a test vehicle that was performed with the disclosed transition framework 1 incorporated into bridge transition assembly 5, tested in accordance with MASH testing protocols. In FIG. 11, the vehicle has a centerline of travel 120, and a line of critical impact point, or CIP 122. To satisfy the test requirements, vehicle centerline 120 is at an angle of 25° to bridge transition assembly 5. As seen in FIG. 11, deflector panel 42 serves to discourage an impacting vehicle from snagging on guardrail post 110.

In the MASH 3-21 test, a 5000-lb pickup truck impacts the CIP of the transition at a nominal impact speed and angle of 62 mi/h and 25 degrees, respectively. This test investigates a barrier's ability to successfully contain and redirect light trucks and sport utility vehicles.

On Apr. 19, 2022, testing was performed on the disclosed embodiment of the invention having a single field-side thrie beam 80 and a pair of nested road-side thrie beams 70 and 74. Table 2 below demonstrates the success of bridge transition assembly 5 in actual testing on a 2006 Dodge Ram 1500 weighing 4,950 lbs. performed by Applus IDIADA KARCO Engineering.

Table 2

General Information
- Test Agency: Applus IDIADA KARCO Engineering, LLC
- Test Number: P42020-01
- Test Date: Apr. 19, 1922
- Test Article: Northern Infrastructure Products, Bridge Connection Test Vehicle
- Description: 2270P, MASH 3-21
- Test Inertial Mass: 2277 kg
- Gross Static Mass: 2277 kg Impact Conditions
- Speed: 100.5 km/h
- Angle: 25.0 degrees Occupant Risk Factors
- Impact Velocity (m/s) at 0.0977 seconds on left side of interior
- x-direction 7.1
- y-direction −8.1
- THIV (km/hr): 37.7 at 0.0943 seconds on left side of interior
- THIV (m/s): 10.5
- Ridedown Accelerations (g's)
- x-direction −10.3 (0.1262-0.1362 seconds)
- y-direction 9.2 (0.1009-0.1109 seconds)
- PHD (g's): 12.9 (0.0942-0.1042 seconds)
- ASI: 1.57 (0.0801-0.1301 seconds)

Max. 50 msec Moving Avg. Accelerations (g's)
- x-direction −9.8 (0.0407-0.0907 seconds)
- y-direction 11.4 (0.0461-0.0961 seconds)
- z-direction 4.0 (1.9955-2.0455 seconds)

Max Roll, Pitch, and Yaw Angles (degrees)
- Roll −54.6 (0.5143 seconds)
- Pitch −15.8 (1.1275 seconds)
- Yaw 46.9 (0.4890 seconds))

As seen from the test results, transition framework 1 as incorporated in bridge transition assembly 5 provides a safe bridge transition for vehicles of very different sizes that passes all criteria of MASH Test 3-20 and MASH Test 3-21 requirements and provides the several advantages described herein.

It will be readily understood by a person of ordinary skill in the art that transition framework 1 and transition assembly 5 are not limited to the application of bridge entrance and egress, but can be used where other solidly anchored road barrier elements need to be transitioned to less resistive barrier elements.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and, in a manner, consistent with the scope of the invention.

The invention claimed is:

1. A transition framework for connection to a concrete anchor at a bridge entrance in a bridge barrier transition, comprising:
- a tubular upper chord having first and second beveled ends;
- a tubular lower chord having first and second beveled ends;
- an approach deflector, comprising:
  - a weldment panel welded to the first beveled end of each of the tubular upper and lower chords;
  - a connection panel disposed at an obtuse angle to the weldment panel;
  - a plurality of vertically separated fastener holes on the connection panel; and,
  - a deflector panel disposed at an obtuse angle to the connection panel; and,
- an anchorage plate welded to the second beveled end of each of the upper and lower chords.

2. The transition framework of claim 1, further comprising:
- the approach deflector connectable to a guardrail post; and,
- the anchorage plate connectable to a bridge anchor.

3. The transition framework of claim 1, further comprising:
- the upper chord and lower chord being 4.5" outside diameter, schedule 80 tubulars.

4. The transition framework of claim 1, further comprising:
- wherein impact forced separation of the upper chord and the lower chord is resisted by the weldment of the ends of the upper chord and the lower chord to the approach deflector and the anchorage plate.

5. A transition framework for connection to a concrete anchor at a bridge entrance in a bridge barrier transition, comprising:
- a tubular upper chord having first and second beveled ends;
- a tubular lower chord having first and second beveled ends;
- an approach deflector welded to the first beveled end of each of the upper and lower chords;
- an anchorage plate comprising:
- a weldment panel welded to the second beveled end of each of the upper and lower chords;
- a connection panel disposed at an obtuse angle to the weldment panel; and,
- a plurality of vertically separated holes on the connection panel.

6. The transition framework of claim 5, further comprising:
- the approach deflector connectable to a guardrail post; and,
- the anchorage plate connectable to a bridge anchor.

7. The transition framework of claim 5, further comprising:
- the upper chord and lower chord being 4.5" outside diameter, schedule 80 tubulars.

8. The transition framework of claim 5, further comprising:
- wherein impact forced separation of the upper chord and the lower chord is resisted by the weldment of the ends of the upper chord and the lower chord to the approach deflector and the anchorage plate.

9. A transition assembly, comprising:

a transition framework comprising:

a tubular upper chord having first and second ends;

a tubular lower chord having first and second ends;

an approach deflector welded to the first end of each of the upper and lower chords;

an anchorage plate welded to the second end of each of the upper and lower chords;

the approach deflector affixed to a guardrail post;

the anchorage plate affixed to an anchor structure;

a first thrie-beam having a first end and an opposite second end;

the first thrie-beam positioned on a road-side of the transition assembly, and over the upper chord and the lower chord;

the first thrie-beam affixed to the approach deflector and the guardrail post at its first end, and to a terminal connector at its second end; and, the terminal connector attached to the anchorage plate and the anchor structure at its second end.

10. The transition assembly of claim 9, further comprising:

a second thrie-beam having a first end and an opposite second end;

the second thrie-beam positioned on top of the first thrie-beam in a nested configuration;

the second thrie-beam affixed to the first thrie-beam, the approach deflector, and the guardrail post at its first end; and, the second thrie-beam attached to the first thrie-beam at its second end.

11. The transition assembly of claim 9, further comprising:

a field-side thrie-beam having a first end and an opposite second end;

the field-side thrie-beam positioned on a field side of the transition assembly, and on top of the upper chord and the lower chord; and, the field-side thrie-beam connected to the first thrie-beam with fasteners.

12. The transition assembly of claim 9, further comprising:

the approach deflector connectable to a guardrail post; and, the anchorage plate connectable to the anchor.

13. The transition assembly of claim 9, further comprising:

the upper chord and lower chord being 4.5" outside diameter, schedule 80 tubulars.

14. The transition assembly of claim 9, further comprising:

vertical expansion of the thrie-beam on impact is resisted by fixed endpoints of the upper chord and lower chord, thus increasing the resistance to deformation.

15. The transition assembly of claim 9, the transition assembly further comprising:

the first and second ends of the tubular upper chord being beveled ends; and, the first and second ends of the tubular lower chord being beveled ends.

16. The transition assembly of claim 15, the anchorage plate further comprising:

a weldment panel welded to the second beveled end of each of the upper and lower chords;

a connection panel disposed at an obtuse angle to the weldment panel; and, a plurality of vertically separated holes on the connection panel.

17. The transition assembly of claim 10, the approach deflector further comprising:

a weldment panel welded to the first beveled end of the upper and lower chords;

a connection panel disposed at an obtuse angle to the weldment panel;

a plurality of vertically separated fastener holes on the connection panel; and, a deflection panel disposed at an obtuse angle to the connection panel.

18. The transition assembly of claim 10, the anchorage plate further comprising:

a weldment panel welded to the second beveled end of each of the upper and lower chords;

a connection panel disposed at an obtuse angle to the weldment panel; and, a plurality of vertically separated holes on the connection panel.

19. The transition assembly of claim 10, further comprising:

wherein vertical expansion of the thrie-beam on impact is resisted by its positioning over the transition framework, and the weldment of the ends of the upper chord and the lower chord of the transition framework to the approach deflector and the anchorage plate.

* * * * *